US005977047A

United States Patent [19]

Carr

[11] Patent Number: 5,977,047

[45] Date of Patent: Nov. 2, 1999

[54] CARBONATE BUILT LAUNDRY DETERGENT CONTAINING A CARBOXYLIC POLYMER AS AN ANTIENCRUSTATION AGENT

[75] Inventor: Charles D. Carr, Yardley, Pa.

[73] Assignee: Church & Dwight Co., Inc., Princeton, N.J.

[21] Appl. No.: 09/087,940

[22] Filed: May 28, 1998

[51] Int. Cl.[6] ..... C11D 3/37; C11D 3/10

[52] U.S. Cl. ..... 510/361; 510/299; 510/300; 510/320; 510/351; 510/476; 510/509

[58] Field of Search ..... 510/276, 299, 510/300, 351, 361, 509, 320, 476, 533, 528

[56] References Cited

U.S. PATENT DOCUMENTS

| | | | |
|---|---|---|---|
| 3,858,854 | 1/1975 | Win et al. | 252/89 |
| 4,265,790 | 5/1981 | Winston et al. | 252/532 |
| 4,464,292 | 8/1984 | Lengyel | 252/532 |
| 5,308,530 | 5/1994 | Aronson et al. | 252/174.12 |
| 5,376,300 | 12/1994 | Bolkan et al. | 252/174.14 |
| 5,431,836 | 7/1995 | Carr et al. | 252/174.14 |
| 5,821,216 | 10/1998 | Cala et al. | 510/509 |

*Primary Examiner*—Ardith Hertzog
*Assistant Examiner*—Dawn L. Garrett
*Attorney, Agent, or Firm*—Irving Fishman

[57] ABSTRACT

A laundry detergent composition in which the solids content comprises an active surfactant, at least about 60 wt. %, based on the weight of the solids of a soluble alkaline carbonate builder, and a minor amount of a carboxylic polymer which is a copolymer of about 70 to about 95 wt. % of acrylic acid and about 5 to about 30 wt. % of maleic acid based on the weight of the polymer, such copolymer having a number average molecular weight of about 1500 to about 2500. Preferably the composition also contains a minor amount of a protease enzyme.

15 Claims, No Drawings

CARBONATE BUILT LAUNDRY DETERGENT CONTAINING A CARBOXYLIC POLYMER AS AN ANTIENCRUSTATION AGENT

CROSS-REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to laundry detergent compositions having a high water-soluble alkaline carbonate builder content.

2. Description of the Related Art Including Information Disclosed Under 37 CFR 1.97 and 1.98

Laundry detergent compositions comprising a water-soluble alkaline carbonate are well-known in the art. For example, it is conventional to use such a carbonate as a builder in detergent compositions which supplement and enhance the cleaning effect of an active surfactant present in the composition. Such builders improve the cleaning power of the detergent composition, for instance, by the sequestration or precipitation of hardness causing metal ions such as calcium, peptization of soil agglomerates, reduction of the critical micelle concentration, and neutralization of acid soil, as well as by enhancing various properties of the active detergent, such as its stabilization of solid soil suspensions, solubilization of water-insoluble materials, emulsification of soil particles, and foaming and sudsing characteristics. Other mechanisms by which builders improve the cleaning power of detergent compositions are probably present but are less well understood. Builders are important not only for their effect in improving the cleaning ability of active surfactants in detergent compositions, but also because they allow for a reduction in the amount of the surfactant used in the composition, the surfactant being generally much more costly than the builder.

While laundry detergents containing a relatively large amount of carbonate builder are generally quite satisfactory in their cleaning ability, the use of such carbonate builders often results in the problem of calcium carbonate precipitation, which may give rise to fabric encrustation due to the deposition of the calcium carbonate on the fiber surfaces of fabrics which in turn causes fabric to have a stiff hand and gives colored fabrics a faded appearance. Thus, any change in available carbonate built laundry detergent compositions which reduces their tendency to cause fabric encrustation is highly desirable.

The following prior art references may be considered relevant or material to the invention claimed herein.

U.S. Pat. No. 3,858,854, issued Jan. 7, 1975 to Win et al., discloses detergent compositions comprising a surfactant which may be anionic, monionic or amphoteric, or a mixture of two or more of such surfactants, a water-soluble builder salt which may be sodium carbonate or bicarbonate, and beads comprising an enzyme which may be a protease.

U.S. Pat. Nos. 4,265,790, issued May 5, 1981 to Winston et al.; 4,464,292, issued Aug. 7, 1984 to Lengyel; and 5,376,300, issued Dec. 27, 1994 to Bolkan et al., each discloses detergent compositions comprising an ethoxylated long chain alcohol and a sulfate of an ethoxylated long chain alcohol as a combination of nonionic and anionic surfactants, and over 70 wt % of anhydrous sodium carbonate (soda ash) as a detergent builder. These patents also teach that enzymes may be present in their compositions, and the Bolkan et al patent states that a carboxylic polymer, e.g. a copolymer of acrylic and maleic acids, may be included in the composition.

U.S. Pat. No. 5,308,530, issued May 3, 1994 to Aronson et al., discloses detergent compositions comprising a carboxylic polymer builder and anti-redeposition agent containing a $C_8$–$C_{18}$ alkyl group, a calcium-sensitive enzyme which may be a protease, and a surfactant.

BRIEF SUMMARY OF THE INVENTION

In accordance with this invention, a laundry detergent composition is provided in which the solids content comprises an active surfactant, at least about 60 wt. % based on the weight of the solids of a soluble alkaline carbonate builder, and a minor amount of a carboxylic polymer which is a copolymer of about 70 to about 95 wt. % of acrylic acid and about 5 to about 30 wt. %; of maleic acid based on the weight of the polymer, such copolymer having a number average molecular weight of about 1,500 to about 2,500. The detergent composition has been found to have an unexpectedly low amount of the fabric encrustation which usually results from use of a high carbonate detergent composition.

BRIEF DESCRIPTION OF THE SEVERAL VIEWS OF THE DRAWING

Not Applicable

DETAILED DESCRIPTION OF THE INVENTION

The active surfactant component of the detergent composition of this invention may be, for example, one or more of many suitable synthetic detergent active compounds which are commercially available and described in the literature, e.g., in "Surface Active Agents and Detergents," Volumes 1 and 2 by Schwartz, Perry and Berch. Several detergents and active surfactants are also described in, for example, U.S. Pat. Nos. 3,957,695; 3,865,754; 3,932,316 and 4,009,114. In general, the composition may include a synthetic anionic, nonionic, amphoteric or zwitterionic detergent active compound, or mixtures of two or more of such compounds.

More preferably, the laundry detergent compositions of this invention contain at least one anionic or nonionic surfactant, and, most preferably, a mixture of the two types of surfactant.

The contemplated water soluble anionic detergent surfactants are the alkali metal (such as sodium and potassium) salts of the higher linear alkyl benzene sulfonates and the alkali metal salts of sulfated ethoxylated and unethoxylated fatty alcohols, and ethoxylated alkyl phenols. The particular salt will be suitably selected depending upon the particular formulation and the proportions therein.

The sodium alkybenzenesulfonate surfactant (LAS), if used in the composition of the present invention, preferably has a straight chain alkyl radical of average length of about 11 to 13 carbon atoms.

Specific sulfated surfactants which can be used in the compositions of the present invention include sulfated ethoxylated and unethoxylated fatty alcohols, preferably linear primary or secondary monohydric alcohols with $C_{10}$–$C_{18}$, preferably $C_{12}$–$C_{16}$, and more preferably, $C_{11}$–$C_{15}$, alkyl groups and, if ethoxylated, on average about 1–15, preferably 2–12, and most preferably 2–7 moles of ethylene oxide (EO) per mole of alcohol, and sulfated ethoxylated alkylphenols with $C_8$–$C_{16}$ alkyl groups, preferably $C_8$–$C_9$ groups, and on average from 4–12 moles of EO per mole of alkyl phenol.

The preferred class of anionic surfactants are the sulfated ethoxylated linear alcohols, such as the $C_{12}$–$C_{16}$ alcohols ethoxylated with an average of from about 1 to about 12 moles of ethylene oxide per mole of alcohol. A most preferred sulfated ethoxylated detergents is made by sulfating a $C_{12}$–$C_{15}$ alcohol ethoxylated with 2.5–4.5 moles of ethylene oxide per mole of alcohol.

Specific nonionic surfactants which can be used in the composition of the present invention include ethoxylated fatty alcohols, preferably linear primary or secondary monohydric alcohols with $C_{10}$–$C_{18}$, preferably $C_{12}$–$C_{16}$, and more preferably $C_{11}$–$C_{15}$, alkyl groups and on average about 1–15, preferably 1–12 moles of ethylene oxide (EO) per mole of alcohol, and ethoxylated alkylphenols with $C_8$–$C_{16}$ alkyl groups, preferably $C_8$ –$C_9$ alkyl groups, and on average about 4–12 moles of EO per mole of alkyl phenol.

The preferred class of nonionic surfactants are the ethoxylated linear alcohols, such as the $C_{12}$–$C_{16}$ alcohols ethoxylated with an average of from about 1 to about 12 moles of ethylene oxide per mole of alcohol. A most preferred nonionic detergent is a $C_{12}$–$C_{15}$ alcohol ethoxylated with 2.5–4.5 moles of ethylene oxide per mole of alcohol.

Mixtures of the foregoing synthetic detergent types of surfactants, e.g., of anionic and nonionic, or of different specific anionic or nonionic surfactants, may be used to modify the detergency, sudsing characteristics, and other properties of the composition. For example, a mixture of different fatty alcohols of 12 to 15 carbon atoms may be ethoxylated, directly sulfated, or sulfated after ethoxylation, a fatty alcohol may be partially ethoxylated and sulfated, or an ethoxylated fatty acid may be partially sulfated to yield a mixture of different anionic and nonionic surfactants or different specific anionic or nonionic surfactants.

The total active surfactant in the composition may be in the range, for example, of about 5 to 15 wt. % preferably about 8 to 12 wt. % based on the weight of solids in the composition. If, as preferred, the active surfactant consists of a combination of anionic and nonionic surfactants, then the anionic surfactant is present in the range, for example, of about 4 to 14 wt. %, preferably about 5 to 10 wt. %, and the nonionic surfactant is present in the range, for example, of about 2 to 8 wt. %, preferably about 3 to 5 wt. %, all based on the weight of total solids.

The water-soluble alkaline carbonate builder in the detergent composition of this invention may be, for example, an alkali metal carbonate, bicarbonate or sesquicarbonate, preferably sodium or potassium carbonate, bicarbonate or sesquicarbonate, and most preferably sodium carbonate. A combination of more than one of such compounds may be used, e.g., sodium carbonate and sodium bicarbonate. The total water-soluble alkaline carbonate may be present in an amount, for example, of at least about 60 wt. %, preferably about 70 to about 85 wt. %. If a combination of alkali metal carbonate and bicarbonate is used as the water-soluble carbonate, then the alkali metal carbonate, e.g., sodium carbonate, is preferably used in an amount of about 70 to about 84 wt. % and the alkali metal bicarbonate, e.g., sodium bicarbonate, in an amount of about 08 to about 15 wt. %. All the foregoing percentages are based on the total solids in the composition.

The contemplated carboxylic polymer is a copolymer of from about 70 to about 95, preferably about 85 to about 93 wt. %, of acrylic acid with from about 5 to about 30, preferably about 7 to about 15 wt. %, of maleic acid, based on the weight of the copolymer, such copolymer having a number average molecular weight of about 1500 to about 2500, preferably about 1700 to about 2300. In particular a copolymer of about 90 wt. % of acrylic acid with about 10 wt. % of maleic acid having a number average molecular weight of about 2000 is suitable. To ensure substantial water solubility, the polymer is completely or partially neutralized, e.g., with alkali metal ions, preferably sodium ions. The carboxylic polymer may be partially or completely neutralized with base prior to being compounded with the other components of the detergent composition or it may be compounded as unneutralized polymer which is partially or completely neutralized in situ during washing by basic compounds, generally the alkaline carbonate builder, e.g., sodium carbonate, which has the effect of raising the pH of the composition.

The carboxylic polymer, which acts as a soil dispersion/antinucleation agent, may be present in an amount, for example, of about 0.025 to about 1.9 wt. %, preferably about 0.05 to about 1.4 wt. %, calculated as solid unneutralized polymer and based on the total weight of the solids in the composition. When completely or partially neutralized with sodium hydroxide, the polymer salt is present in an amount somewhat greater than that of the corresponding unneutralized polymer because of the greater weight of the neutralizing sodium ions over the replaced hydrogen of the unneutralized polymer.

To improve its soil removing function, the detergent composition of this invention preferably also contains a protease enzyme, also known in the art as a proteolytic enzyme. The enzymes falling within this art-recognized class include, for example, those disclosed in U.S. Pat. Nos. 3,858,854 of Win et al. and 5,308,530 of Aronson et al., previously cited, and 4,318,818 of Letton et al.; German Offenlegenschrift No. 1,800,508; published Dutch Patent Application No. 6,815,944; and Novo's Handbook of Practical Biotechnology, Novo Industri A/S, 1986, pp 54–57. Specific protease enzymes which may be used are, for example, pepsin, trypsin, chymotrypsin, papain, bromelin, colleginase, keratinase, carboxylase, amino peptidase, elastase, subtilisia and aspergillopepidase A and B. Preferred enzymes are subtilisin enzymes manufactured and cultivated from special strains of spore forming bacteria, particularly Bacillus subtilis. Some suitable commercially available protease enzymes are Alcalase, Savinase and Esparase, all from Novo Industri A/S, Maxatase and Maxacal from Gist-Brocades, and Kazusase from Showa Denko. The protease enzyme may be present in the composition in an amount from about 0.04 to about 1.6 wt. %, preferably about 0.3 to about 1.1 wt. % based on the weight of the solids in the composition.

The detergent compositions of the invention are generally intended to be non-phosphate, i.e., to exclude the presence of phosphate-containing builders and phosphate-containing sequestering agents such as sodium tripolyphosphate (STPP) since such agents tend to cause eutrophication when present in discarded wash water. However, for certain purposes a small amount of such agents, e.g., up to about 0.5 wt. % as phosphorus based the weight of solids in the composition, may be present.

The detergent composition of this invention is preferably in the form of a dry-appearing powder, in which case the weight percentages of the various components mentioned previously are approximately based on the weight of the total composition. However, such dry appearing powder generally contains water in an amount, for example, of about 1 to 12 wt. %, preferably about 2 to 10 wt. % based on the weight of the total composition.

The laundry detergent compositions of this invention may also contain various other adjuvants common to detergent formulations such as optical brighteners, carboxymethylcellulose, perfumes, dyes, pigments, solubility enhancers such as potassium chloride, other builders such as sodium sulfate, and peroxide generating persalts as bleaching agents.

The following examples further illustrate the invention:

EXAMPLES 1–4 AND COMPARATIVE EXAMPLE A

These examples illustrate the low level of encrustation caused by a detergent composition of this invention containing the contemplated polymer, as compared with an identical composition except that it contains a closely related but uncontemplated polymer.

In Comparative Example A, a control composition was prepared containing the components listed in Table I in the indicated amounts in grams.

TABLE I

| Component | Amount (grams) |
|---|---|
| Sodium Carbonate | 73.79 |
| Anionic Surfactant | 5.60 |
| Nonionic Surfactant | 3.09 |
| Carboxylic Polymer Solids-Na Salt | 0.99 |
| Optical Brightener (Solids) | 0.20 |
| Sodium Carboxymethylcellulose (100% active) | 0.21 |
| Sodium Bicarbonate | 0.95 |
| Water | 5.23 |
| Perfume | 0.09 |
| Potassium Chloride | 2.85 |
| Sodium Sulfate | 2.01 |

Of the components in Table I, the anionic surfactant was the sodium salt of a sulfated $C_{12}$–$C_{14}$ alcohol ethoxylated with about 3 moles of ethylene oxide per mole of alcohol, the nonionic surfactant was a $C_{12}$–$C_{14}$ alcohol ethoxylated with about 3 moles of ethylene oxide per mole of alcohol, and the carboxylic polymer was the sodium salt of a copolymer of about 90 wt. % of acrylic acid and about 10 wt. % of maleic acid, having a number average molecular weight of about 3000 (Rohm and Haas Polymer 448). The anionic and nonionic surfactants, and the sodium sulfate together constituted the reaction product of the partial sulfation of the nonionic surfactant with concentrated sulfuric acid, followed by neutralization of the sulfated product with sodium carbonate, as disclosed in previous cited U.S. Pat. No. 4,464,292 of Lengyel.

In Examples 1–4, the detergent contained the same components in the amounts listed in Table I except that the carboxylic polymer-Na salt was the sodium salt of a copolymer of about 90 wt. % of acrylic acid and about 10 wt. % of maleic acid, having a number average molecular weight of about 2000 in amounts of 0.50, 0.99, 1.98 and 2.97 grams, respectively.

The five detergent compositions were tested for fabric encrustation by repeated washing of cotton fabric at 35° C. with wash water containing 250 ppm of Ca and Mg hardness with a Ca/Mg molar ratio of 2:1, such hardness determined as $CaCO_3$ as described in ASTM D1126-86. In carrying out each test, four 25.4 cm. ×25.4 cm., 1000% single stitched cotton fabric swatches are washed for 12 min. with 95 g of the detergent composition being tested such that the wash liquor contained about 0.14 wt. % of detergent. After washing is completed, 2.00–4.00 g of the calcium carbonate encrusted fabrics are extracted in 100 ml. of 0.2 N hydrochloric acid for 30 min, and a 2.0–4.0 ml. aliquot is analyzed for hardness by the EDTA titration method. Encrustation is expressed as mg. calcium carbonate per gram of fabric obtained after 3 and 5 machine cycles of use. The results are shown in Table II.

TABLE II (Single Stitched Cotton Swatches)

| | Encrustation | |
|---|---|---|
| Example | 3 Cycles | 5 Cycles |
| A | 90 | 160 |
| 1 | 32 | 135 |
| 2 | 10 | 60 |
| 3 | 8 | 38 |
| 4 | 5 | 21 |

The foregoing determinations of encrustation caused by the five positions were repeated, except that the washed fabric were double-stitched interlocked cotton swatches. The results are shown in Table III.

TABLE III (Double-Stitched Cotton Swatches)

| | Encrustation | |
|---|---|---|
| Example | 3 Cycles | 5 Cycles |
| A | 102 | 169 |
| 1 | 69 | 158 |
| 2 | 33 | 101 |
| 3 | 20 | 74 |
| 4 | 10 | 39 |

The foregoing determinations of encrustation caused by the five positions were repeated, except that the washed fabrics were double-stitched (interlocked) swatches of poly/cotton (50% polyester/50% cotton). Results are shown in Table IV.

TABLE IV (Double-Stitched Poly/Cotton Swatches)

| | Encrustation | |
|---|---|---|
| Example | 3 Cycles | 5 Cycles |
| A | 33 | 103 |
| 1 | 12 | 73 |
| 2 | 4 | 34 |
| 3 | 4 | 21 |
| 4 | 1 | 9 |

The results shown in Table II, III and IV indicate that with regard to the three types of swatches tested, and after 3 and 5 cycle of washing, the presence in the detergent composition of a polymer contemplated under the invention (Example 1–4) caused substantially less encrustation than when the composition contained a closely related but uncontemplated polymer (Comparative Example A), despite the fact that in Example 1 an amount of contemplated polymer was present in the composition which was only half that of the uncontemplated polymer present in the composition of Comparative Example A. Furthermore, successively and significantly lower amounts of encrustation resulted in most cases when the amount of contemplated polymer was twice (Example 2), 4 times (Example 3) and 6 times (Example 4), the amount present in the composition of Example 1.

EXAMPLE 5 AND COMPARATIVE EXAMPLE B

These examples illustrate the substantial improvement in cleaning ability with respect to the removal of certain types of stains which is obtained when a protease enzyme is present in the detergent composition of this invention. In Comparative Example B, the detergent composition contained the components shown in Table V at the indicated weight percentages.

TABLE V

| Component | Amount (grams) |
|---|---|
| Sodium Carbonate | 76.68 |
| Anionic Surfactant | 5.89 |
| Nonionic Surfactant | 3.25 |
| Carboxylic Polymer Solids, Salt | 0.58 |
| Optical Brightener (Solids) | 0.21 |
| Sodium Carboxymethylcellulose (100% Active) | 0.22 |
| STPP | 1.45 |
| Sodium Bicarbonate | 1.00 |
| Water | 5.50 |
| Perfume | 0.11 |
| Potassium Chloride | 3.00 |
| Sodium Sulfate | 2.12 |

Of the components listed in Table V, the anionic and nonionic surfactants are the same as those in the composition of Comparative Example A, as listed in Table I; the carboxylic polymer was a conventional anti-redeposition agent for detergents, viz., the sodium salt of a polymeric blend of 50 wt. % of a polyacrylic acid having a number average molecular weight of about 4500, and 50 wt. % of a copolymer of 50:50 acrylic and methacrylic acids having a number average molecular weight of about 3500 (Rohm and Haas Polymer 912), a conventional effective anti-redeposition agent; and STPP is sodium tripolyphosphate.

Following the procedure of ASTM D-3050 utilizing full size Whirlpool washing machines, swatches of cotton and poly/cotton (a blend of 50 wt. % cotton and 50 wt. % polyester) stained with various common substances, were washed at 95° F. with 95 grams of the detergent composition of Comparative Example B using a 12 minute wash cycle time and wash water containing 100 ppm of calcium and magnesium hardness with a Ca/Mg molar ratio of 2:1, such hardness calculated as $CaCO_3$ as described in ASTM D 1126-86. Four replicate stained swatches were used for each determination, two in each of two machines. Reflectances of the clean samples, the stained samples and the washed samples were measured using a standard spectrophotometer, and the percent stain removal was calculated from the spectrophotometer measurements.

In Example 5, the same detergent composition was tested as in Comparative Example B, except that the carboxylic polymer sodium salt in the composition was the same polymer contemplated under the invention as used in the compositions of Examples 1–4, and was present in the composition of this example in an amount of about 0.42 wt. %; the composition also contained about 0.82 wt. % of "Savinase" protease enzyme sold by Novo Industri A/S; and the cleaning trials employed 85 rather than 95 grams of detergent composition.

Results in terms of the percent removal of the various stains from the different fabrics by washing with the detergent compositions of Comparative Example B and Example 5 are shown in Table VI, wherein "EMPA 116" indicates the staining by a mixture of blood, milk and carbon black on cotton, and "EMPA 117" indicates the staining by a mixture of blood, milk and carbon black on poly/cotton. The acronym, "EMPA," stands for "Eldgenossiche Materials Prufungs Anstalt," a Swiss government testing center. Each of the numerical values of Example 5 in Table VI has been determined to present a statistically significant increase over the corresponding values in Comparative Example B, having been determined in accordance with least significant differences (LSD) as derived from a utilization of one way analysis of variance (ANOVA) per Statgraphics software package.

TABLE VI

| Stained Sample | Comp. Ex. B | Example 5 |
|---|---|---|
| Grass on Cotton | 47.1 | 62.7 |
| EMPA 116 on Cotton | 45.4 | 61.8 |
| EMPA 117 on Poly/Cotton | 22.1 | 74.4 |

The results shown in Table V indicate that detergent compositions containing a polymer contemplated under the invention and a protease enzyme (Example 5) is effective in removing substantially larger proportions of certain test stains than a composition containing a carboxylic polymer which is a known anti-redeposition agent, but no enzyme (Comparative Example B). This indicates the advantages of the composition of the invention in removing certain stains generally considered quite difficult to remove.

It should be noted that the compositions of these examples contain 1.45 wt. % of STPP (0.36 wt % as phophorus), although, as previously stated, it is preferred that no phosphate be present in the composition or its amount limited to no more than about 0.5 wt. % as phophorus of the solids in the composition. The reason for the inclusion of STPP in the compositions of these examples is that as known in the art, phosphate builders such as STPP contribute significantly to the detergency or cleaning ability of detergent compositions. Thus, the contribution of a protease enzyme to such cleaning ability was felt to more clearly shown if it was in addition to that of a phosphate present in the composition than if no phosphate were present. For most purposes, however, it is preferred that a phosphate not be present in the composition because such phosphates in discarded wash water have been shown to be a major cause of eutrophication of various bodies of water.

I claim:

1. A laundry detergent composition in which the solids content comprises an active surfactant, at least about 60 wt. % based on the weight of the solids of a soluble alkaline carbonate builder, and a minor amount of a carboxylic polymer which is a copolymer of about 85 to about 93 wt. % of acrylic acid and about 7 to about 15 wt. % of maleic acid based on the weight of the polymer present in the range of about 0.025 to about 1.9 wt. % calculated as solid unneutralized polymer and based on the weight of solids in the composition, said copolymer having a number average molecular weight of about 1500 to 2500.

2. The composition of claim 1 wherein said molecular weight is from about 1700 to about 2300.

3. The composition of claim 1 wherein said range of carboxylic polymer is about 0.05 to about 1.4 wt. %.

4. The composition of claim 1 wherein said alkaline carbonate builder is sodium carbonate.

5. The composition of claim 4 wherein said sodium carbonate is present in an amount of about 70 to about 84 wt. %.

6. The composition of claim 5 which also comprises about 1 to about 15 wt. % of sodium bicarbonate.

7. The composition of claim 1 wherein said active surfactant comprises an anionic surfactant and a nonionic surfactant.

8. The composition of claim 7 wherein said anionic surfactant is an alkali metal salt of sulfated linear $C_{12}$–$C_{16}$ alcohols ethoxylated with an average of about 1 to about 12 moles of ethylene oxide per mole of alcohol and is present in an amount of about 4 to 14 wt. %, and said nonionic surfactant consists of $C_{12}$–$C_{16}$ linear alcohols ethoxylated with an average of about 1 to about 12 moles of ethylene oxide per mole of alcohol and is present in an amount of about 2 to 8 wt. % based on the weight of total solids.

9. The composition of claim 1 also containing a minor amount of a protease enzyme.

10. The composition of claim 9 wherein said enzyme is present in an amount in the range of about 0.04 to about 1.6 wt. % based on the weight of the solids in the composition.

11. The composition of claim 10 wherein said range is from about 0.3 to about 1.1 wt. %.

12. The composition of claim 1 containing substantially no phosphate.

13. The composition of claim 1 containing a phosphate in an amount no more than about 0.5 wt. as phosphorus, based on the weight of the solids in the composition.

14. The composition of claim 13 wherein said phosphate is sodium tripolyphosphate (STPP) which is present in an amount no more than about 2 wt % as STPP, based on the weight of solids in the composition.

15. A process comprising washing a fabric in an aqueous wash liquor containing the composition of claim 1.

* * * * *